United States Patent [19]

Gätschmann et al.

[11] Patent Number: 5,072,740

[45] Date of Patent: Dec. 17, 1991

[54] DEVICE FOR FILLING PREFABRICATED CIGARETTE TUBES, ESPECIALLY FILTER TIPPED CIGARETT TUBES

[75] Inventors: Klaus G. Gätschmann; Gunter Schütze, both of Trossingen, Fed. Rep. of Germany

[73] Assignee: Efka-Werke Fritz Kiehn GmbH, Fed. Rep. of Germany

[21] Appl. No.: 526,903

[22] Filed: May 21, 1990

[30] Foreign Application Priority Data

May 22, 1989 [DE] Fed. Rep. of Germany ..... 3916589

[51] Int. Cl.[5] ..... A24C 5/06

[52] U.S. Cl. ..... 131/75; 131/70; 131/76

[58] Field of Search ..... 131/70, 75, 76

[56] References Cited

U.S. PATENT DOCUMENTS

| | | | |
|---|---|---|---|
| 2,430,491 | 11/1947 | Burns | 131/75 |
| 3,732,873 | 5/1973 | O'Rear | 131/70 |
| 4,005,716 | 2/1977 | Messner et al. | 131/70 |
| 4,534,367 | 8/1985 | Newsome | 131/75 |
| 4,770,191 | 9/1988 | Moscovitch | 131/75 |

*Primary Examiner*—Vincent Millin

*Assistant Examiner*—Lynne A. Reichard

*Attorney, Agent, or Firm*—Andrus, Sceales, Starke & Sawall

[57] ABSTRACT

A device for filling prefabricated cirgarette tubes, especially filter-tipped cigarette tubes, comprising a tobacco pressing chamber (14) with a filling opening (13), in which tobacco introduced through the filling opening (13) is pressed to form a tobacco rod (10) by means of a pressing beam (17) movable transversely to the longitudinal direction of the tobacco pressing chamber (14), a socket for fitting the cigarette tube thereon, clamping means for retaining the cigarette tube on the socket, and an ejector (25) for ejecting the tobacco rod (10) from the pressing chamber (14) into the cigarette tube. In order to prevent tobacco fibres from projecting out of the filling opening of the tobacco pressing chamber, a separate lid (1) cooperates with the filling opening (13) of the tobacco pressing chamber (14), the closing movement of said lid being in advance of the movement of the pressing beam (17) is pressing direction. Preferably, the tobacco rod (10) is overcompressed prior to being ejected from the pressing chamber (14). Also, the cigarette tube on the socket is clamped diametrically during the filling operation.

15 Claims, 3 Drawing Sheets

DEVICE FOR FILLING PREFABRICATED CIGARETTE TUBES, ESPECIALLY FILTER TIPPED CIGARETT TUBES

BACKGROUND OF THE INVENTION

The present invention is directed to a device for filling prefabricated cigarette tubes, especially filter-tipped cigarette tubes, with tobacco.

There are a number of more or less convenient devices of the specified kind, all of the commonly used devices having an elongated pressing chamber which is defined on one side by an approximately semi-circular fixed wall portion and on the other side by an opposed semi-circular surface of a movable pressing beam by means of which the pressing chamber can be closed after having been filled with tobacco to result in a rod-like tobacco supply. On one end face of the pressing chamber there is provided a socket for application and fitting thereon of an empty cigarette tube. At the opposite end the pressing chamber is defined by a plunger-like tobacco ejector by means of which the tobacco supply may be transferred from the pressing chamber into the cigarette tube (cf. for instance DE-A-2,833,681; DE-C-2,139,242; DE-C-2,064,641; AT-A-146,213; FR-A-427,582; U.S. Pat. No. 638,904 or DE-A-3,135,700). To ensure safe operation, the devices commonly employed today also have a half-shell like spoon mounted on the effective end of the ejector bar for promoting or even enabling the transfer of the tobacco supply from the pressing chamber into the cigarette tube while at the same time maintaining the stability of the latter.

These known filling devices have proven more or less satisfactory in practical use. However, they exhibit the drawback that transfer of the tobacco from the pressing chamber into the cigarette paper tube has not been solved sufficiently satisfactorily by all of the prior known structural features. Among other things, they exhibit the drawback that upon filling of the tobacco pressing chamber the user must always take care to have as little tobacco fibres as possible project from the edge of the filling opening, because it happens frequently that during further handling a considerable number of the projecting tobacco fibres get jammed between the pressing beam and the edge of the filling opening opposite thereto, whereby reliable ejection of the tobacco rod from the pressing chamber and transfer thereof into the cigarette tube can no longer be ensured. In some cases the jammed tobacco fibres will hamper ejection of the tobacco rod to such an extent that the latter is upset longitudinally within the tobacco pressing chamber, and consequently the cigarette tube will either be filled but incompletely or, when the upset and therefore highly compressed tobacco supply is transferred, will break away from the fitting socket, in which case most cigarette tubes will burst and the ejected tobacco will crumble accordingly. Until recently, it was attempted to eliminate this problem by designing the upper edge of the pressing beam as cutting edge so that projecting tobacco fibres are cut off when the tobacco is compressed. But so far the corresponding measures have not proven sufficiently adequate, which is due to some extent to the existing tolerances and the materials normally used for the casing on the one hand, and the pressing beam, on the other hand.

SUMMARY OF THE INVENTION

The present invention is based on the object of considerably improving, with simple means, the operational reliability of filling devices of the specified kind, whereby handling thereof is also substantially facilitated.

The specified object is solved by a device having an elongated tobacco pressing chamber with a side filling opening for receiving tobacco which is compressed to form a tobacco rod by moving a pressing beam transversely to the longitudinal direction of the chamber. A movable lid is mounted for movement over the filling opening of the chamber for closing and opening said filling opening with the lid moving to the closing position in advance of pressing movement of the pressing beam. A socket is coupled to the pressing chamber and the cigarette tube fits on the socket. An ejector ejects the tobacco rod into the cigarette tube. The lid according to the invention ensures that the tobacco filled into the tobacco pressing chamber is contained substantially completely within the pressing chamber prior to being compressed. The proportion of projecting tobacco fibres is minimized while the functional reliability is correspondingly increased as compared with the above-discussed prior art. It is preferred that the lid according to the invention is supported for reciprocating movement in parallel with the pressing beam and is coupled to the handling member connected with the pressing beam in such a way that the movement of the pressing beam in pressing direction will only commence when the lid is in the position in which it closes the filling opening. Thereby any remaining tobacco projecting through the lid is practically "rolled" into the still enlarged tobacco pressing chamber so that all of the tobacco is practically fully contained within the tobacco pressing chamber before it is compressed to form the tobacco rod to be transferred. At the same time, in the preferred embodiment the closing lid is coupled to the handling member associated with the pressing beam such that actuation of the handling member closing and opening movement of the lid and the reciprocating movement of the pressing beam are simultaneously achieved. To this end, corresponding cams are provided either on the pressing beam and the lid or on the handling member for operating the pressing beam and/or the ejector bar with the closing opening of the lid specified in claims 3 and 4.

For promoting the mentioned "rolling-in" of projecting tobacco fibres into the still enlarged tobacco pressing chamber, the free front edge of the lid facing the pressing chamber is beveled on the pressing chamber side while simultaneously forming a knife-like cutting edge for shearing cooperation with the opposite edge of the filling opening. Due to this structural measure, any discrete projecting tobacco fibres will be cut off when the filling opening is closed, so that it is ensured that ejection of the compressed tobacco rod from the tobacco pressing chamber will not be obstructed by jammed tobacco fibres.

Both independently of the above-mentioned configuration and especially in combination therewith the compression beam moves in accordance with a further significant feature in the best mode to over compress the tobacco fibres and reduce the compression chamber size to less than the size of the cigarette tube. Due to the proposed overcompression of the tobacco within the tobacco pressing chamber and relieving the compressed tobacco rod for ejection from the tobacco pressing chamber to normal size or slightly less it is possible to do without the above-mentioned spoon at the ejection end of the ejector bar. In this connection it should be considered that the half-skilled like of the prior art is an extremely fragile component part which may easily break when handled clumsily and may also cause injury to the user. In the case of very moist tobacco there is even a risk that during the return movement of the ejector bar the spoon may draw tobacco out of the cigarette tube. Therefore the mentioned spoon can be obviated due to the inventive overcompression of the tobacco. There is no difficulty in transferring the tobacco rod into the cigarette paper tube without a spoon, i.e. only by means of the ejector bar or plunger. It is also intended that the invention shall be directed to the described method of preparing a tobacco rod within a tobacco pressing chamber, in which initially the tobacco rod is overcompressed such that its cross-section will be smaller than the cross-section of the tobacco accommodating volume of the fitted cigarette tube, whereupon the tobacco rod is relieved radially either directly before or during ejection, so that its cross-section will adopt normal size and is preferably only slightly smaller than the free cross-section of the tobacco accommodating volume of the fitted cigarette tube. Thereafter the tobacco rod may be transferred into the tobacco accommodating volume of the fitted cigarette tube without a spoon, i.e. only be means of a blunt ejector bar or plunger.

Finally, other features are disclosed which are also important both independently of the above-mentioned proposals and especially in combination therewith. In the prior art the cigarette tube fitted onto the socket is clamped on one side only and consequently, when a relatively taut tobacco rod is transferred, the cigarette paper tube breaks away from the socket while being damaged correspondingly in the clamped region. By diametrical clamping this danger is minimized, and the reject rate is reduced correspondingly. Providing a compliant pressing face on the clamping elements provides for particularly careful handling of the clamped cigarette paper tube.

BRIEF DESCRIPTION OF THE DRAWINGS

Below, some embodiments of the specified invention(s) will be explained in detail with reference to the accompanying schematic drawings, in which.

DESCRIPTION OF THE ILLUSTRATED EMBODIMENT

Figure 1:
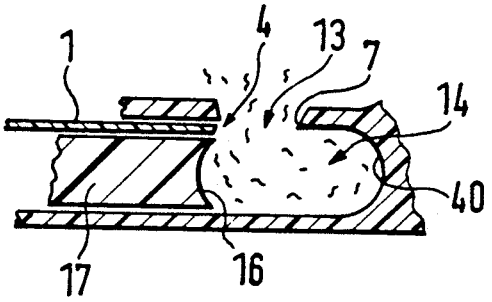
FIGS. 1-3 are schematic cross-sections each illustrating the closing movement of a lid according to the invention for the filling opening of the tobacco pressing chamber relative to the movement of the associated pressing beam.

First of all, an embodiment of a device for filling prefabricated cigarette tubes, especially filter-tipped cigarette tubes, with tobacco will be described with reference to FIG. 3*a*. The device comprises a casing with a casing lower part 11 and a casing upper part 12. An elongated opening, i.e. a tobacco filling opening 13, is formed in the casing upper part and opens into a tobacco pressing chamber 14. The pressing chamber 14 is defined, 40 on one side, by a semi-circular wall portion, and on the other side, by an opposite semi-circular face 16 of a horizontally movable pressing beam 17. The internal wall portion 40 is part of an outer sidewall 41 which is associated with the pressing chamber 14 and is formed as a double wall and the outer wall portion 42 of which is movable in abutting direction relative to the internal wall portion 40. To this end the outer wall portion 42 is provided with an extension 43 protruding through an elongated slot 44 in the internal wall portion 40 and slidably supported therein. The extension 43 carries a plunger-like ejector bar 25. The wall portion 42 and the ejector bar 25 constitute an integral part adapted for joint reciprocating movement in longitudinal direction of the tobacco pressing chamber 14. Furthermore, the outer wall portion 42 is joined to the housing lower part 11 by means of an undercut guideway 46, whereby a linear guide means is formed. A grip 29 is disposed on the top of the outer wall portion 42. The end 20 of the pressing beam 17 which is diametrically opposite the wall portion 16 is coupled to a lever 21 which at the same time is configured as a handling member 23. This handling member may, for instance, be an injection moulded plastics part. The handling member 23 is mounted for pivoting movement about a horizontal axis defined by pivot pins 22 integrally formed on the sides of the handling member 23. These pivot pins 22 are pivotally supported in half-shell bearing seats 45 and are retained in said bearing seats 45 by a projecting lug 39 on the inside of the casing top part 12.

The diametrical end 20 of the pressing beam 17 has two axially spaced L-shaped side plates 24 formed integrally therewith; the mutually facing inner sides of the side plates are respectively formed with L-shaped cam grooves 2 into which guide pins 6 integrally formed with the sides of the handling member 23 project, wherein the two guide pins 6 are respectively formed on the two outer sides of the lateral defining walls of the handling member 23. The inner sides of the lateral defining walls of the handling member 23 likewise have guide pins integrally formed therewith which are in alignment with the guide pins 6. These guide pins correspond to respective arcuate cam grooves 3 formed on the outer side of two likewise axially spaced side plates 18, which are disposed between the already mentioned L-shaped side plates 24 and form part of a lid 1 reciprocable between the casing upper part 12 and the pressing beam 17. The cam grooves 2 and 3 are configured and provided relative to each other such that, when the handling member 23 is operated in pressing direction (arrow 19), the filling opening 13 of the tobacco pressing chamber 14 is closed by the lid 1 so that the closing movement of the lid is in advance of the movement of the pressing beam 17 in the pressing direction. Preferably, the lid 1 which is reciprocable in parallel to the pressing beam 17 is coupled to the handling member 23 in such a way that the movement of the pressing beam 17 in pressing direction will only commence when the lid 1 is in the position to close the filling opening, as illustrated in FIG. 2. To this end the embodiment of FIG. 3*a* is provided with the L-shaped cam groove 3, wherein the shorter leg extends in spaced relationship to the pressing beam 17 approximately parallel with the direction of movement thereof away from the pressing chamber 14. Furthermore, the clear width of the upper horizontal leg of the cam groove 2 is larger than the outer diameter of the associated pin 6, so that upon rotation of the handling member 23 from the filling position in pressing direction 19, the guide pin 26 in the upper horizontal leg of the cam groove 2 will initially remain ineffective, and consequently the pressing beam 17 will remain in its retracted position shown in FIG. 3*a*. But the pins which are integrally formed with the inner side of the handling member 23 and respectively aligned with the pins 6 will correspond from the very beginning to the cam grooves 3 associated with the lid 1, so that the lid 1 is moved in closing direction without any delay and consequently the filling opening 13 is already completely closed before the pressing beam 17 becomes effective. The described sequence of motions can be reconstructed with reference to FIGS. 1 to 3. When the tobacco pressing chamber is opened, the sequence of motions will be exactly reversed, i.e. the lid 1 is retarded with respect to the pressing beam 17.

For the pressing beam 17 to remain in the pressing position the lower end of each cam groove 2 is formed with an enlargement 15 for latching engagement of the guide pins 6 therein. As will be apparent from FIG. 3*a*, the enlargement 15 and thus the mentioned latching engagement are below the imaginary line connecting the tobacco pressing chamber 14 and the pivot bearing of the handling member 23. Therefore the latched position of the handling member 23 is an "overcentre position".

Figure 2:
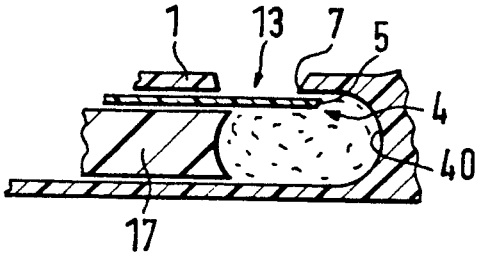
Figure 3:
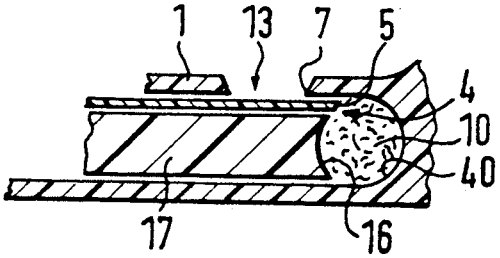
Figure 3A:
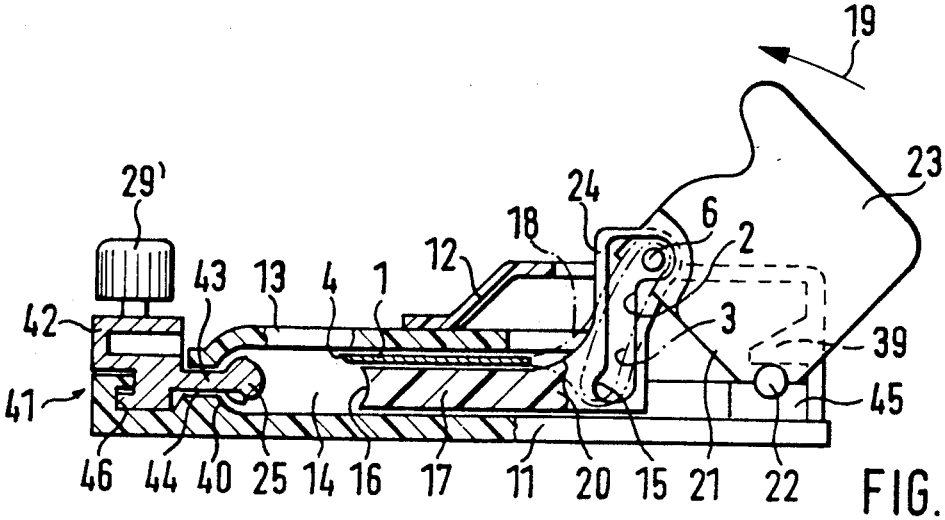
FIG. 3*a* is a cross-section of an embodiment of a filling device provided with a closing lid according to the invention.
Figure 4:
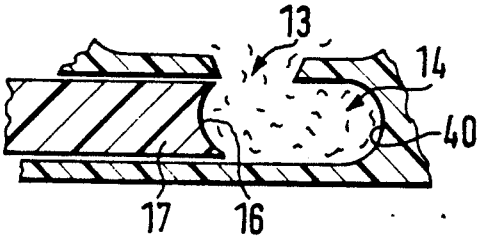
FIGS. 4-6 are schematic cross-sections respectively illustrating the sequence of motion of a pressing beam with overcompression of the tobacco rod and subsequent pressure relief prior to ejecting the rod from the tobacco pressing chamber.
Figure 5:
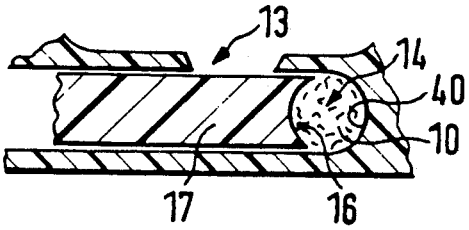
Figure 6:
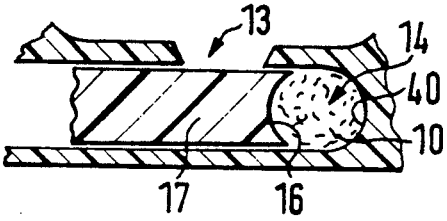

As shown in FIGS. 1 to 3, tobacco is initially filled through the filling opening 13 into the tobacco pressing chamber 14. Then the filling opening 13 is closed by the advancing lid 1, the front edge 4 of the lid facing the pressing chamber 14 being bevelled on the pressing chamber side to form a knife-like cutting edge 5. Thereby the tobacco charge is practically "rolled" into the tobacco pressing chamber 14 when the opening 13 is closed by the lid 1. Any possibly protruding tobacco fibres are severed between the cutting edge 5 and the defining edge 7 of the filling opening 13 opposite the pressing beam 17, so that the tobacco charge is practically fully contained within the tobacco pressing chamber 14. The tobacco bar 10 finally formed according to FIG. 3 is then ejected from the tobacco pressing chamber 14 without any difficulties. As will also be apparent from FIG. 3, in the tobacco pressing position of the pressing beam 17 the front edge 4 of the lid 1 is approximately flush with the curved pressing face 16 of the pressing beam 17 to form a corresponding continuation of the pressing face 16 of the pressing beam 17.

With reference to FIGS. 4 to 6 and 9 to 12 an embodiment will be described in which the pressing beam 17 is movable to a position of overcompression (FIG. 5) in which the free cross-section of the pressing chamber 14 is significantly smaller than the free cross-section of the tobacco accommodating volume of the cigarette tube (not illustrated), and in which either directly before or at least upon ejection of the tobacco bar 10 (FIG. 6) from the pressing chamber 14 the pressing beam 17 is retracted approximately to "normal size", i.e. to a position in which the free cross-section of the tobacco pressing chamber 14 is approximately equal to, and preferably only slightly less than, the free cross-section of the tobacco accommodating volume of the fitted cigarette tube. It is preferred that the tobacco is initially compressed to a cross-sectional size which is smaller than the "normal size" by about 10 to 20%, whereafter it is relieved either before or upon ejection from the pressing chamber 14 to a size which is smaller than the "normal size" by only about 3 to 6%; the mentioned movements of the pressing beam 17 being controlled by a cam groove (cam) optionally coupled to the ejector and not illustrated in detail. The last-mentioned measure may be combined with the above-described lid configuration. But it may also be employed independently; in particular it is possible to modify conventional filling devices accordingly, so that the above-mentioned spoon at the ejecting end of the ejector can be eliminated.

Figure 9:
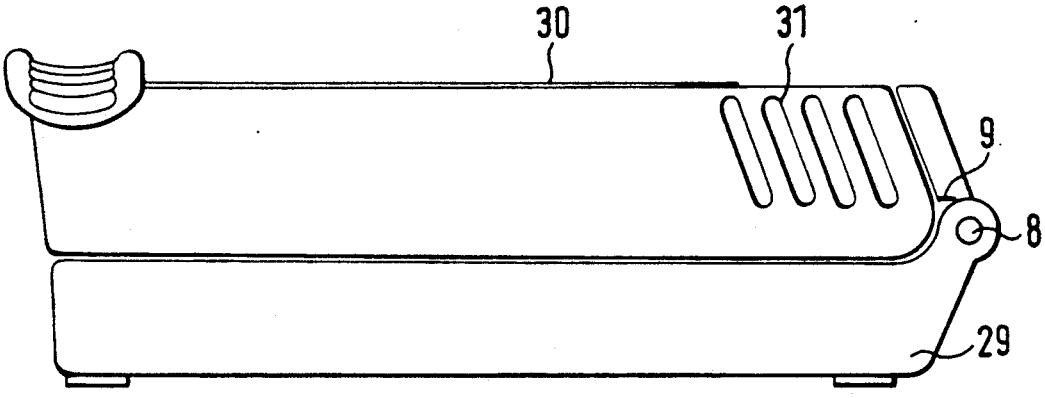
FIG. 9 is a side view of a further embodiment of a filling device according to the invention.
Figure 10:
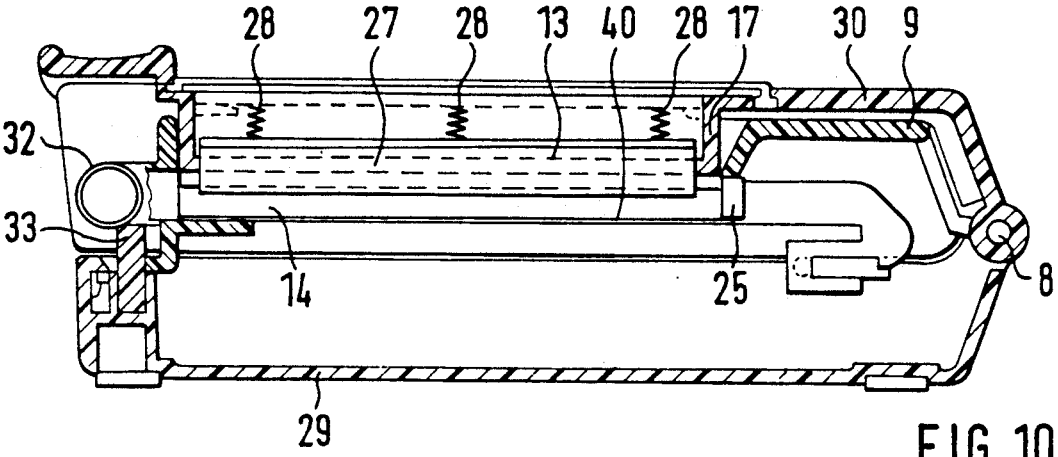
FIG. 10 is a longitudinal sectional view of the device of FIG. 9.
Figure 11:
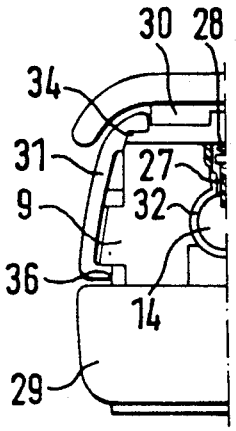
FIGS. 11 and 12 are an end view and a partly sectional view of the device of FIGS. 9 and 10, respectively.
Figure 12:
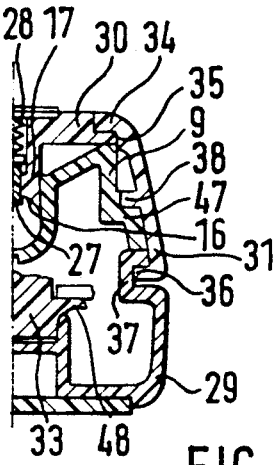

In the embodiment illustrated in FIGS. 9 to 12, the pre-and overcompression of the tobacco is effected in an extremely simple way by a compression bar 27 cooperating with the pressing beam, said compression bar in the illustrated embodiment extending through the pressing beam 17 substantially along the entire length of the tobacco pressing chamber 14, wherein the compression bar 27 is resiliently compliantly supported on the side remote from the tobacco pressing chamber 14 by spring elements, in the present case by helical compression springs 28. In order to ensure that prior to ejection of the tobacco rod from the tobacco pressing chamber 14 the compression bar 27 no longer provided two abutments (not illustrated in detail) at either of the diametrical ends of the compression bar 27 for causing a movement of the compression bar 27 out of the pressing chamber 14 in the pressing position of the pressing beam 17, preferably in such a way that the side of the compression bar 27 presented to the tobacco pressing chamber 14 is flush with the pressing face 16 of the pressing beam 17. In this way the axial movement of the ejector upon transfer of the compressed tobacco rod into a fitted cigarette tube is not obstructed by the compression bar 27. In FIGS. 10 to 12 the compression bar 27 protrudes into the tobacco pressing chamber 14 for clarity's sake. But in the illustrated position of the filling device the compression bar 27 should have been moved out of the tobacco pressing chamber by the mentioned abutments against the action of the compression springs 28 such that the side of the compression bar 27 presented to the tobacco pressing chamber 14 is flush with the pressing face 16 of the pressing beam 17. It is preferred that the mentioned abutments, which are not shown in detail in the drawings, have the effect of moving the compression bar 27 out of the pressing chamber 14 only just before the pressing beam 17 has reached the final pressing position.

For a better understanding of the filling device illustrated in FIGS. 9 to 11 this will be explained in detail below. From FIG. 9 it will be apparent that in the illustrated filling device a casing 9 and a lid 30 are pivotally joined to a bottom part 29 via a hinge pin 8 provided thereon. On the side of the casing a handling member 31 connected to the ejector is mounted for movement in parallel with the bottom part 29.

FIG. 10 is a longitudinal sectional view of the device illustrated in FIG. 9. The bottom part 29 is approximately tub-shaped and carries a hinge pin formation 8 at its rear end about which hinge pin a casing 9 and a lid 30 are mounted for pivotal movement, as already mentioned. On its top surface that casing 9 is provided with a pan-like filling opening 13 through which tobacco may be filled into a tobacco pressing chamber 14. The underside of the lid 30 is provided with a pressing beam 17 for compressing the tobacco filling to such an extent that it will form a tobacco rod adapted to be pushed into a cigarette tube fitted to a socket 32. Similar to the previous embodiments, the ejector is referenced 25. In the bottom part 29 there is provided a clamping member 33 for clamping the cigarette tube (not illustrated) against the socket 32 during the filling operation. The lid 30 has side lugs 34 for engagement in grooves 35 of the casing and guidance therein during the filling operation such that the lid 30 is locked relative to the ejector or the handling member 31 thereof and also relative to the casing 9. At the rear, the tobacco pressing chamber 14 is defined by the ejector 25.

FIGS. 11 and 12 are end views, wherein FIG. 11 is an end view of the filling device in the closed state prior to the filling operation while FIG. 12 is a section through the device behind the end wall of the casing 9.

It will be apparent from FIG. 3 that the filling device consists substantially of four parts, viz. the bottom part 29, the casing 9, the lid 30 and the handling member 31 cooperating with the ejector 25. A lug 34 of the lid 30 engages beneath a groove 35 in the handling member 31 of the ejector 25, while a guide web 36 of the handling member 31 engages beneath a guide angle 37 of the bottom part 29. The handling member 31 joined to the ejector 25 is guided by means of a guide web 38 in a groove 37 within the casing 9. The bottom part 29 furthermore comprises at least one spring 48 acting from below against the casing 9 to urge it away from the bottom part 29 in the inoperative condition. This also ensures a spacing between the clamping element 33 and the socket 32 in the inoperative condition.

As the illustrated basic structure of the filling device is a conventional filling device, the above explanation of the individual structural features will be sufficient, and a description of the mode of operation appears unnecessary. In this respect reference shall be made, inter al., to DE-A-3,135,700.

Figure 7:
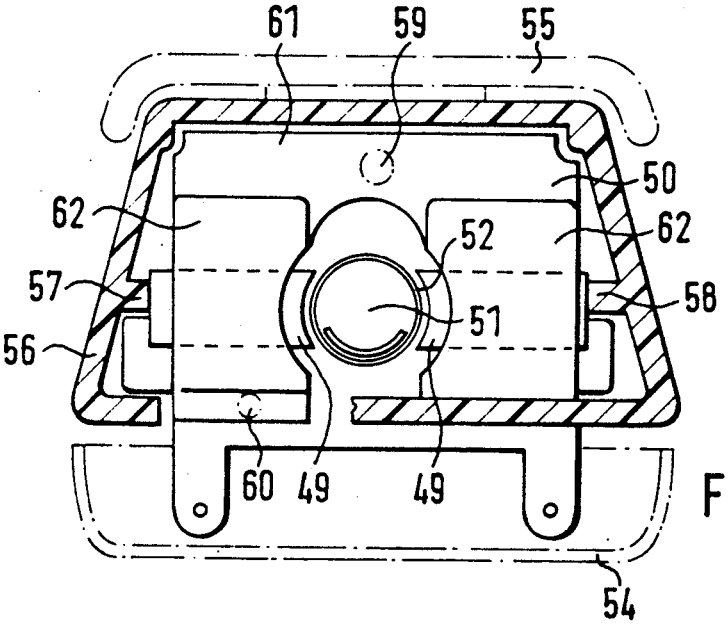
FIG. 7 is an end view of a filling device provided with a diametrically acting clamping means.
Figure 8:
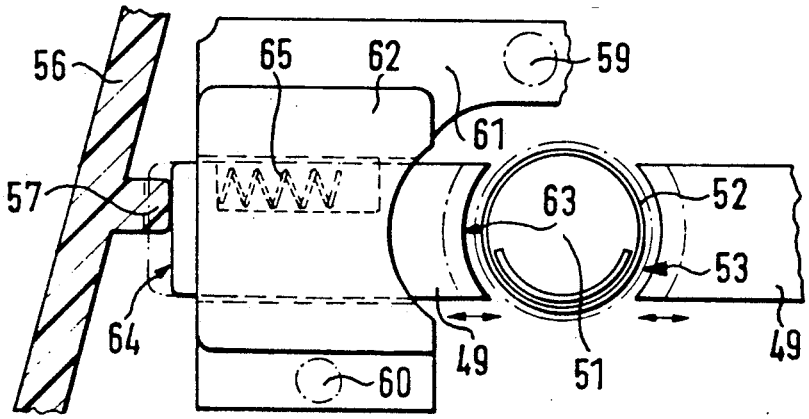
FIG. 8 shows partly in section a part of the filling device of FIG. 1, i.e. the clamping means thereof.

FIGS. 7 and 8 show a further embodiment of a filling device similar to that of FIGS. 9 to 12, the gist of this embodiment residing in the diametrical provision of clamping elements 49 and the operation thereof. The illustrated filling device includes a front wall 50 formed with an exit opening 51 for the tobacco rod formed within the tobacco pressing chamber (not illustrated), a socket 52 with a cigarette tube 53 (FIG. 8) to be fitted thereon being disposed at said exit opening. The device is completed by a bottom part 54 and a cover part 55. A handling member 56 connected to the non-illustrated ejector is moved on parallel, inwardly directed lateral webs 57, 58 along the filling portion which is pivotable while it is otherwise fixed to the system. A retaining member 61 with a retaining block 62 for accommodating and guiding a clamping element 49 is mounted for example by rivets 59, 60 or the like on the front wall 50. The ends 63 of the clamping elements 49, which ends cooperate with the socket 52, are respectively concave, said clamping elements being arranged diametrically relative to the socket 52. The respective other ends 64 are in sliding contact with the webs 57, 58 of the handling member 56. Each of the clamping elements 49 is acted upon by a resilient part, especially an elastic pressure element such as a compression spring 65, which in the inoperative condition urge the clamping elements 49 away from the socket 52. The clamping elements 49, which are preferably guided in horizontal direction, also are inoperative when the spring 65 is relieved as soon as the retaining blocks 62 are respectively disposed in one of the end regions of the webs 57, 58 either before or after actuation of the handling member 56 cooperating with the ejector, in which state the clamping elements 49 adopt the dash-dot-line positions illustrated in FIG. 8. This also establishes the spacing between the concave ends 63 of the clamping elements 49 and the outer wall of the socket 52 which spacing is required for fitting or removal of the cigarette tube 4 onto or from the socket 52. When the handling member 56 including the prepared tobacco rod is moved in axial direction while taking along the non-illustrated ejector, the clamping elements 49 due to the increasing thickness of the webs 57, 58 are urged towards the socket 52 against the action of the springs 65. Accordingly, for the duration of the filling operation the cigarette tube 53 will be clamped against the outer surface of the socket 52. In this way the cigarette tube can be properly filled. Of course, it would be conceivable especially in the case of other forms of filling devices to provide three or more clamping elements 49 equally spaced about the circumference of the socket 52 so as to ensure reliable retaining of the cigarette tube fitted to the socket 52 for the duration of the tobacco transfer or filling operation. The principle of multiclamping of the cigarette tube on the socket is of paramount importance also for conventional filling devices, but this also applies in combination with the above-described filling devices.

All of the features disclosed in the present application papers are claimed as being essential to the invention to the extent to which they are novel over the prior art either individually or in combination.

We claim:

1. In a device for filling prefabricated cigarette tubes including filter-tipped cigarette tubes and having a free cross-section of a tobacco accommodating volume including an elongated tobacco pressing chamber (14) with a side filling opening (13) for receiving tobacco to be compressed and forming a tobacco rod (10) by means of a pressing beam (17) movable transversely to the longitudinal direction of the tobacco pressing chamber (14) and across said filling opening for compressing the tobacco into a tobacco rod, a socket coupled to the pressing chamber and having means for fitting the cigarette tube on the socket, and an ejector (25) for ejecting the tobacco rod (10) from the pressing chamber (14) into the cigarette tube, comprising the improvement including a movable lid (1) mounted for movement over said filling opening (13) of the tobacco pressing chamber (14) for closing and opening said filling opening and thereby defining a closed chamber, and means to move the lid in a closing movement of said lid with the leading portion of the lid located forwardly of the pressing beam (17) during the movement of the pressing beam in the pressing direction.

2. The device as claimed in claim 1, having a handling member 23 for moving said pressing beam (17) and said lid (1) mounted for reciprocating movement in parallel with the pressing beam (17) and coupled when the handling member (23) such that the movement of the pressing beam (17) is in the pressing direction commences only with the lid (1) in a position closing the filling opening (FIG. 2).

3. The device as claimed in claim 2, including cam means connected to said pressing beam (17) and said lid (1) and to said handling member, said cam means including a cam groove (2 and 3, respectively) in said pressing beam and said lid and having pins (6) formed with said handling member such that upon movement of the handling member (23) in the tobacco pressing direction (arrow 19) the filling opening (13) is closed by the lid (1) before the pressing beam (17) is in its final pressing position.

4. The device of claim 2 wherein said handling member (23) includes first and second cam means, including cam grooves for the pressing beam (17) and for the lid (1) and first and second pins secured to the pressing beam and the lid and disposed in said first and second grooves, so that movement of the handling member (23) in a tobacco pressing direction (arrow 19) moves the lid to close the filling opening (13) before the pressing beam (17) is in its final pressing position.

5. The device as in claim 1 wherein said leading portion of said lid includes a free front edge (4) facing the pressing chamber (14), said free front edge being beveled to form a knife-like cutting edge (5).

6. The device as in claim 1 wherein said pressing beam has a curved pressing face, said lid has a front edge, said front edge being substantially flush with the curved pressing face (16) of the pressing beam (17) in a tobacco pressing position of the pressing beam to constitute a corresponding continuation of the pressing face (16) of the pressing beam (17).

7. The device as in claim 1 wherein said pressing beam (17) is mounted for movement to an overcompression position in which the free cross-section of the pressing chamber (14) is significantly smaller than the free cross-section of the tobacco accommodating volume of the cigarette tube, and to a transfer position for ejection of the tobacco rod (10) from the pressing chamber (14) wherein the pressing beam (17) is approximately in position to define a "normal size" of the tobacco, said normal size of the tobacco being equal substantially to the free cross-section of the tobacco accommodating volume of the cigarette tube.

8. The device of claim 7 wherein said transfer position creates a "normal size of tobacco" slightly smaller than said free cross-section.

9. The device of claim 7, wherein in said overcompressing position said free cross-section of the compressing chamber is smaller than said "normal size" of the tobacco by about 10–20% and in said transfer position of said pressing beam said free cross-section of the compressing chamber is smaller than the "normal size" of the tobacco by about 3–6%.

10. The device of claim 9 including a cam means to establish said positions.

11. The device of claim 1 including a socket (52) located to receive the compressed tobacco rod, clamping means cooperating with the socket (52) and including at least two clamping elements (49) disposed approximately diametrically of the socket (52), each clamping element being movable perpendicularly to the socket to clamp a cigarette tube (53) onto the socket (52) for transfer of the tobacco rod.

12. The device of claim 11 having guide webs (57, 58) responsive to the tobacco compressing movement of the pressing beam to the pressing position movement of the handling member (56) and cooperating with the ejector (25) to the ejecting position to urge the clamping elements (49) against the socket (52).

13. The device as claimed in claim 11 including elastically compliant padding secured to clamping faces (63) of the clamping elements (49).

14. In a tobacco charge forming device including a casing (9) having a tobacco pressing chamber (14) disposed in longitudinal direction of said casing, a lid-like pressing beam (17) cooperating with said pressing chamber and disposed within a cover (30) which covers said casing (9) and is rotatably about a pivot (8) which is normal to the pressing chamber, and an ejector (25) for ejecting a compressed tobacco rod into a cigarette tube clampingly retained on a socket (32) at the exit in the pressing chamber (14), the improvement in the pressing beam (17) of said device comprising a compression bar (27) extended at least partly through the pressing beam (17) along substantially the entire length thereof, an elastically compliant support (spring elements 28) urging said bar against the side remote from the pressing chamber (14) whereby the introduced tobacco is pre-compressed by the compression bar (27).

15. The device of claim 14 including means coupled to said compression bar (27) such that when the compression bar bears against the casing has the inner portion of the bar facing said tobacco pressing chamber and is substantially flush with the pressing face (16) of the pressing bar (17).

* * * * *

UNITED STATES PATENT AND TRADEMARK OFFICE

CERTIFICATE OF CORRECTION

PATENT NO. : 5,072,740

DATED : December 17, 1991

INVENTOR(S) : KLAUS G. GATSCHMANN ET AL

It is certified that error appears in the above-identified patent and that said Letters Patent is hereby corrected as shown below:

On the title page:

In the Title [54], delete "CIGARETT" and substitute therefor -- CIGARETTE --; References Cited [56] add: 638,904, 12/1899, Buckingham; 3135700, 3/1983, Germany; 2833681, 2/1980, Germany; 2139242, 2/1974, Germany; 2064641, 11/1973, Germany; 146213, 2/1936, Germany.

Signed and Sealed this

Eighth Day of June, 1993

*Attest:*

Michael K. Kirk

MICHAEL K. KIRK

*Attesting Officer*

*Acting Commissioner of Patents and Trademarks*